US007647802B2

(12) United States Patent
Knirk et al.

(10) Patent No.: US 7,647,802 B2
(45) Date of Patent: Jan. 19, 2010

(54) ONE-PIECE FLEXIBLE TUBE CONNECTOR AND METHOD OF MAKING THE SAME

(75) Inventors: Gary Lee Knirk, Carmel, IN (US); Scott S. Sheppard, Brutus, MI (US); Gary Orelyn Crawford, Cheboygan, MI (US)

(73) Assignee: Sunspring America, Inc., Vanderbilt, MI (US)

( * ) Notice: Subject to any disclaimer, the term of this patent is extended or adjusted under 35 U.S.C. 154(b) by 223 days.

(21) Appl. No.: 11/513,399

(22) Filed: Aug. 30, 2006

(65) Prior Publication Data

US 2008/0053177 A1 Mar. 6, 2008

(51) Int. Cl.
*B21D 3/02* (2006.01)

(52) U.S. Cl. ..... 72/115; 72/82; 72/125; 72/370.1; 72/370.15

(58) Field of Classification Search ..... 72/112, 72/115, 117, 125, 126, 370.01, 370.03, 370.1, 72/370.11, 370.15, 82
See application file for complete search history.

(56) References Cited

U.S. PATENT DOCUMENTS

| | | | | |
|---|---|---|---|---|
| 540,314 | A | 6/1895 | Howell | |
| 1,421,507 | A * | 7/1922 | Lindberg | 72/370.11 |
| 2,053,975 | A | 9/1936 | Spatta | |
| 2,268,246 | A | 12/1941 | Dooley | |
| 2,325,480 | A * | 7/1943 | Crawford | 219/152 |
| 2,370,089 | A * | 2/1945 | Swyers | 72/68 |
| 2,494,128 | A * | 1/1950 | Holmquist et al. | 72/340 |
| 3,000,424 | A | 9/1961 | Weise | |
| 3,451,243 | A * | 6/1969 | Gallinger | 72/124 |
| 4,047,415 | A * | 9/1977 | Crane et al. | 72/125 |
| 4,845,972 | A | 7/1989 | Takeuchi | |
| 5,184,495 | A | 2/1993 | Chunn | |
| 5,321,968 | A | 6/1994 | Poole | |
| 5,379,625 | A | 1/1995 | Hale | |
| 5,517,843 | A | 5/1996 | Winship | |
| 5,660,072 | A | 8/1997 | Lee | |
| 5,743,301 | A | 4/1998 | Winship | |
| 5,744,085 | A | 4/1998 | Sorberg | |
| 5,810,054 | A | 9/1998 | Goulet | |
| 5,956,988 | A | 9/1999 | Beste | |
| 6,038,901 | A * | 3/2000 | Stein et al. | 72/85 |
| 6,321,581 | B1 | 11/2001 | Haldenwanger | |
| 6,327,771 | B1 | 12/2001 | Anglin | |
| 6,672,123 | B2 * | 1/2004 | Sczesny et al. | 72/115 |

(Continued)

*Primary Examiner*—Edward Tolan
(74) *Attorney, Agent, or Firm*—Sonnenschein Nath & Rosenthal LLP; Brian R. McGinley; Adam C. Rehm

(57) ABSTRACT

A method of manufacturing a one-piece flexible tube connector includes obtaining a tube blank having an initial length, an initial outer diameter, and an initial wall thickness. The tube blank is secured in a fixture and fed longitudinally into a forming tool. During the forming process, one of the tube blank and the forming tool is spun increasing an initial wall thickness of a portion of the tube blank to a second wall thickness, while the initial outer diameter of the tube blank is controlled. The thickened portion of the tube blank extends along a second length of the tube blank that is less than the initial length. After the spinning process, an attachment feature, such as a barbed feature, is formed or machined into the thickened portion of the tube blank to produce the one-piece flexible tube connector.

19 Claims, 3 Drawing Sheets

U.S. PATENT DOCUMENTS 6,792,782 B2 9/2004 Gouiran
6,817,099 B2 11/2004 Watts
6,918,277 B2 * 7/2005 Takahashi et al. ..... 72/112
6,928,732 B2 8/2005 Sakai
6,957,936 B2 10/2005 Kress
7,418,850 B2 * 9/2008 Kondo ..... 72/370.11
2002/0007547 A1 1/2002 Unewisse

* cited by examiner

ONE-PIECE FLEXIBLE TUBE CONNECTOR AND METHOD OF MAKING THE SAME

BACKGROUND OF THE INVENTION

The present invention is directed to a one-piece flexible tube connector and method of manufacture.

Metal supply tubes are typically used with flexible supply tubing for plumbing applications including water supply systems. Known supply tubes typically consist of a two-piece assembly produced by attaching a fitting onto an end of a thin wall tube. Each fitting is attached to a tube by any of various known methods such as brazing, threading, for example. A separate fitting is attached to the tube because traditional fittings typically include barbed configurations that are too deep to be cut or stamped directly into the thin wall tube. Known fittings typically include barbed configurations that require a wall thickness of approximately 0.112-0.115 inches to accommodate machining the geometry associated with a typical fitting, while a typical thin wall tube used in a water supply system only has wall thickness of 0.040 inches. Therefore, known supply tubes require assembly to attach fittings, which can be costly. In addition, there is a potential risk of mechanical failure and/or leakage associated with the two-piece design.

As such, it would be desirable to provide a flexible tubing connector that is formed as a single piece with the tube, which eliminates the need to attach fittings onto an end of a thin wall tube.

SUMMARY OF THE INVENTION

The present invention includes a one-piece flexible tube connector and method for making the same. The one-piece flexible tube connector includes a portion having an increased wall thickness, which is subsequently formed or machined into a barbed configuration for attachment to, for example, a water supply system.

In one example method of manufacturing a one-piece flexible tube connector, the process includes obtaining a tube blank having an initial length, an initial outer diameter, and an initial wall thickness. The tube blank is secured in a fixture. One of the tube blank and a forming tool is fed longitudinally toward the other of the tube blank and the forming tool. During the forming process, one of the tube blank or the forming tool is spun to increase the initial wall thickness of a portion of the tube blank, while the initial outer diameter of the tube blank is maintained as a constant. The thickened portion of the tube blank extends along a second length of the tube blank that is less than the initial length. The initial length of the tube blank is decreased to a third length that is greater than the second length during the spinning process. After the forming process, an attachment feature, such as a barbed feature, is formed or machined into the thickened portion of the tube blank to produce the one-piece flexible tube connector. A portion of the overall outside diameter is then upset or forced to grow in a localized area to form a shoulder portion having a shoulder diameter that is greater than the overall outside diameter.

In another example, a one-piece flexible tube connector produced by the above method includes a tube having an initial overall length reduced to a final overall length by a forming process, such as a spinning process for example. An overall outer diameter of the tube is constant along the initial overall length. A reduced inner diameter portion is created by the forming process to provide a thickened portion of the tube that has a final inner diameter that is less than the initial inner diameter while the overall outer diameter is maintained. The thickened portion of the tube extends longitudinally along a length of the tube than is less that the final overall length. A portion of the overall outside diameter is then upset or forced to grow in a localized area to form a shoulder portion having a shoulder diameter that is greater than the overall outside diameter.

In another example, a one-piece flexible tube connector produced by the method above includes a first portion and a second portion, which have an overall length and an overall outer diameter that extends along the overall length. The first portion has a first length less than the overall length and a first inner diameter that extends along the first length. The second portion has a second length, which is less than the first inner diameter, and a second inner diameter that extends along the second length. The overall length is equal to the sum of the first length and the second length. An attachment feature is formed or machined into the second portion. The attachment feature includes at least one barb having a valley with a root outer diameter that is less than the overall outer diameter.

In another example, a shoulder portion having a shoulder diameter greater than the overall outer diameter is formed on the outside diameter of the tube blank. The shoulder portion is located proximate to a transition between the first inner diameter and the second inner diameter and provides a positive stop used for assembly purposes.

These and other features of the present invention can be best understood from the following specification and drawings, the following of which is a brief description.

DETAILED DESCRIPTION OF THE PREFERRED EMBODIMENT

Figure 1:
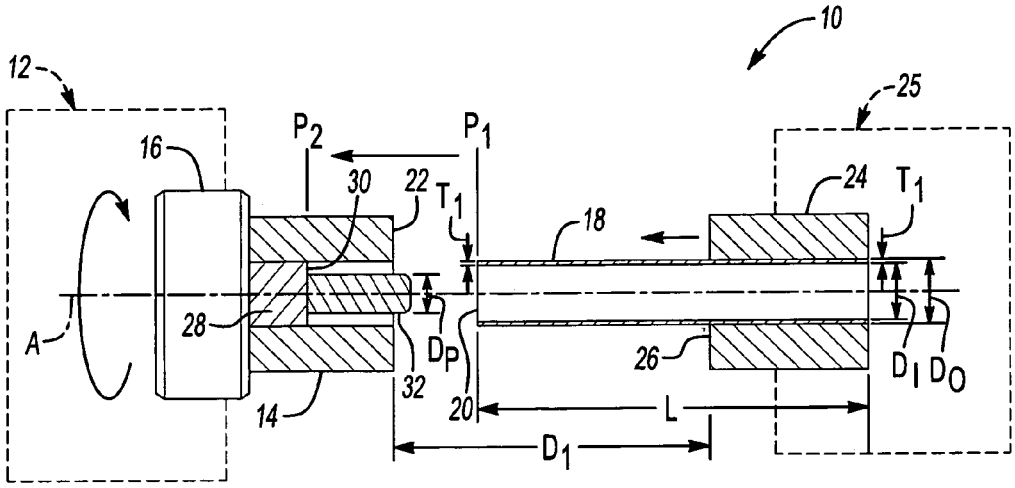
FIG. 1 is a schematic illustration of an example tooling set-up for a manufacturing process according to one embodiment of the present invention.

FIG. 1 schematically illustrates an example tooling set-up 10 for manufacturing a one-piece flexible tube connector (FIG. 6) according to the present invention. A forming machine 12, for example a spinning tool, includes a spinning collar 14 attached to a powered spindle 16, which in this example, rotates in a clockwise manner about an axis A-A. A tube blank 18 is secured in a first horizontal position $P_1$, in which a first end 20 of the tube blank 18 is spaced away from an open end 22 of the spinning collar 14 longitudinally along the axis A-A. The tube blank 18 is secured in the first horizontal position $P_1$ by a clamping device 24, such as a split set of clamp blocks or compressive jaws. In the first horizontal position $P_1$, a leading face 26 of the clamping device 24 is spaced a distance $D_1$ away from the open end 22 of the spinning collar 14. A stop block 28 including a stop surface 30 is disposed within the spinning collar 14. A pilot 32 extends longitudinally outward from the stop surface 30 toward the open end 22 of the spinning collar 14 along the axis A-A.

Figure 1A:
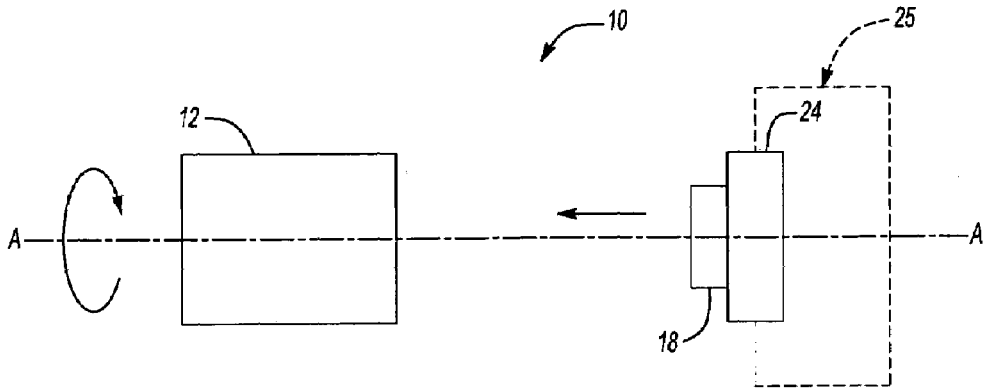
FIG. 1A is another schematic illustration of the example tooling set-up of FIG. 1.

In the above example set-up 10, the forming machine 12 is a spinning tool that includes the spinning collar 14, which spins clockwise about the axis A-A while the forming machine 12 remains stationary longitudinally along the axis A-A. As schematically illustrated in FIG. 1A, the tube blank 18, secured by the clamping device 24, moves longitudinally along the axis A-A toward the stationary rotating forming machine 12.

Figure 1B:
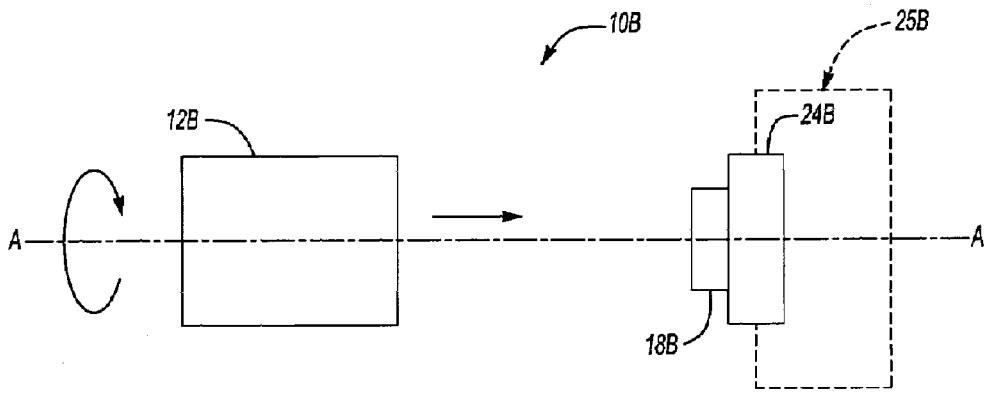
FIG. 1B is a schematic illustration of another example tooling set-up for a manufacturing process according to one embodiment of the present invention.

In another example tooling set-up 10B, schematically illustrated in FIG. 1B, a forming machine 12B is a spinning tool that includes the spinning collar 14, which rotates clockwise about the axis A-A. A tube blank 18B, secured by a clamping device 24B, remains stationary longitudinally along the axis A-A, while the forming machine 12B rotates and moves longitudinally along the axis A-A toward the stationary tube blank 18B.

Figure 1C:
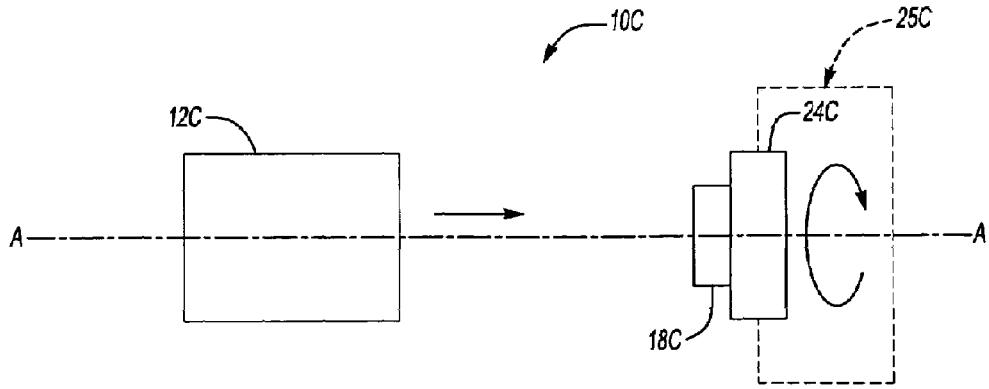
FIG. 1C is schematic illustration of yet another example tooling set-up for a manufacturing process according to one embodiment of the present invention.

In yet another example tooling set-up 10C, schematically illustrated in FIG. 1C, a forming machine 12C is a non-rotating tool that does not rotate about the axis A-A. A tube blank 18C is secured by a clamping device 24C, for example a collet, which is installed into a spinning machine 25C, for example a lathe. The spinning machine 25C spins the tube blank 18C clockwise about the axis A-A, while the spinning machine 25C including the tube blank 18C remain stationary longitudinally along the axis A-A. The forming machine 12C moves longitudinally along the axis A-A toward the spinning machine 25C including the tube blank 18C.

Referring back to FIG. 1, the tube blank 18 includes an overall length L, an outer diameter $D_O$ and an inner diameter $D_I$, which smaller than the outer diameter $D_O$. The overall length L is equal to an initial length $L_1$. An initial wall thickness $T_1$ of the tube blank 18 is equal to one-half of the outer diameter $D_O$ minus the inner diameter $D_I$. The pilot 32 includes a pilot diameter $D_P$, which is smaller than the outer diameter $D_O$.

Figure 2:
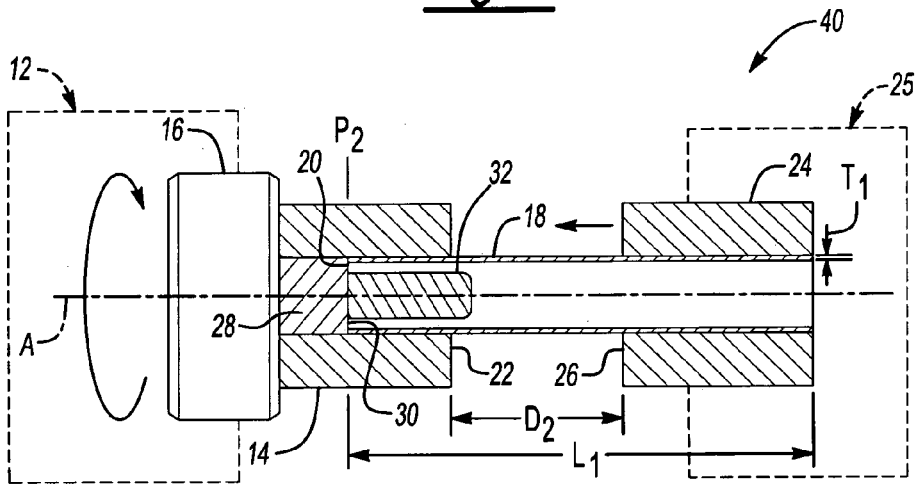
FIG. 2 is a schematic illustration of a feeding position of the manufacturing process according to one embodiment of the present invention.

The tube blank 18 is fed longitudinally along the axis A-A toward the spindle 16, which is rotating clockwise about the axis A-A. As the tube blank 18 approaches the open end 22 of the spinning collar 14, the pilot 32 is received within the inner diameter $D_I$ of the tube blank 18. The first end 20 of the tube blank 18 then enters the open end 22 of the spinning collar 14 and continues to travel longitudinally until the first end 20 of the tube blank 18 contacts the stop surface 30, as shown in FIG. 2. At this point in the manufacturing process, the distance D (FIG. 1) is decreased to a second distance $D_2$ (FIG. 2), and the overall length L, the outer diameter $D_O$ and the inner diameter $D_I$ remain constant.

Figure 3:
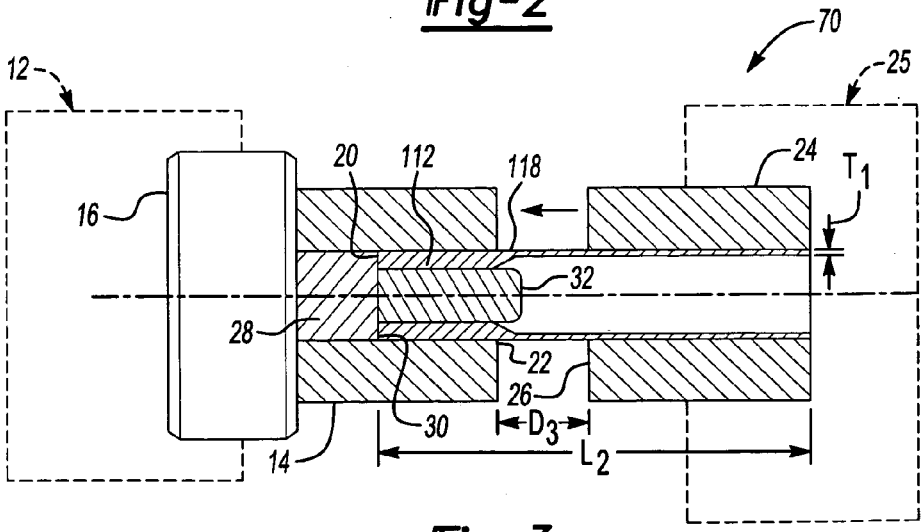
FIG. 3 is a schematic illustration of a compression position of the manufacturing process according to one embodiment of the present invention.
Figure 4:
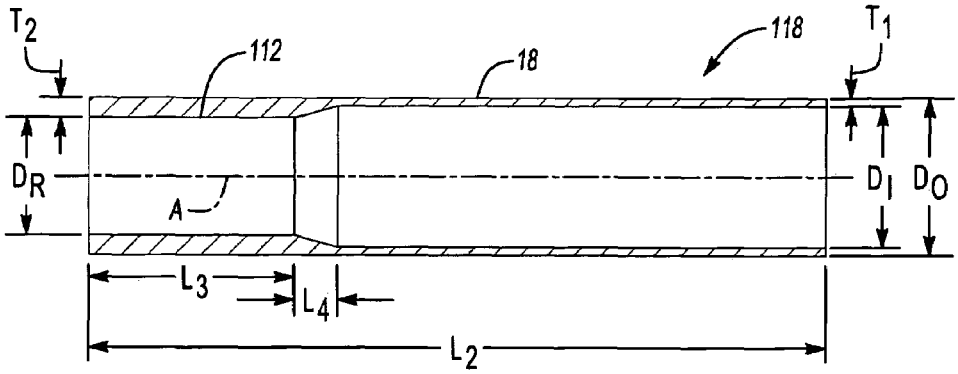
FIG. 4 is a schematic illustration of an example in-process regionally thickened tube blank manufactured according to one embodiment of the present invention.
Figure 5:
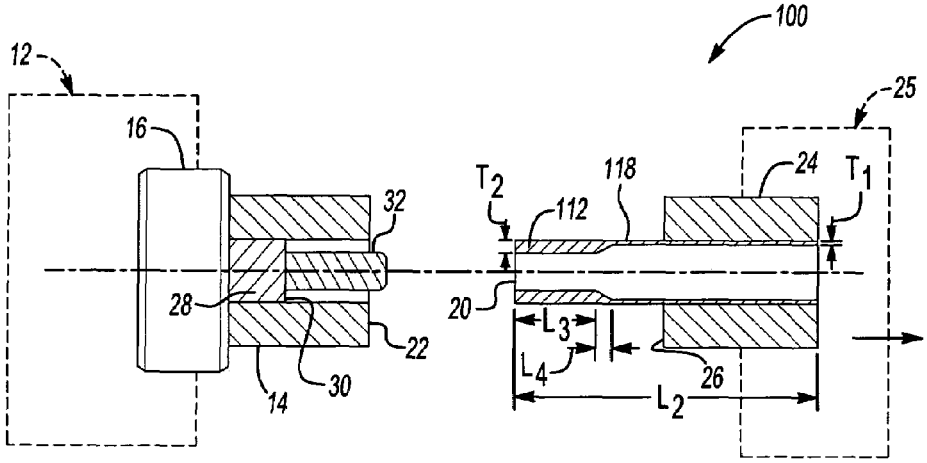
FIG. 5 is a schematic illustration of a final retracted position of the manufacturing process according to one embodiment of the present invention.

Once the first end 20 of the tube blank 18 contacts the stop surface 30, as shown in FIG. 2, the clamping device 24 continues to fed the tube blank 18 longitudinally along the axis A-A, compressing the tube blank 18 longitudinally, as shown in FIG. 3, to form a thickened portion 112. During the compression portion of the process, the overall length L is decreased from the initial length $L_1$ to a final length $L_2$, and the initial wall thickness $T_1$ is increased to a second wall thickness $T_2$ creating a regionally thickened tube blank 118, as shown in FIG. 4. The second wall thickness extends along a third length $L_3$, which is less than the final length $L_2$. The initial inner diameter $D_I$ is decreased to a reduced inner diameter $D_R$ while controlling the outer diameter $D_O$ The reduced inner diameter $D_R$ gradually increases along a fourth length $L_4$ to the initial inner diameter $D_I$.

Figure 6:
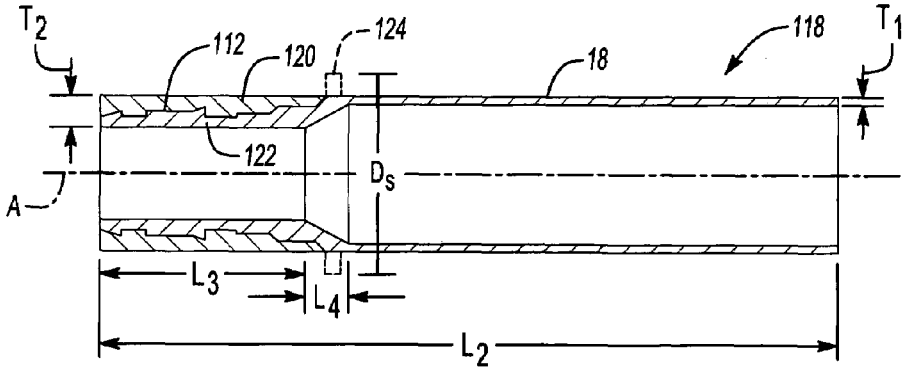
FIG. 6 is a schematic illustration of an example one-piece tube connector manufactured according to one embodiment of the present invention.

The clamping device 24, including the regionally thickened tube blank 118, retracts longitudinally along the axis A-A. A portion 120 of the thickened portion 112 of the regionally thickened tube blank 118 is subsequently formed or machined by conventional means to create a barbed feature 122, as shown in FIG. 6. Additionally, a shoulder portion 124 having a shoulder diameter $D_S$, which is greater that the outer diameter $D_O$, is formed on the tube blank 18 to provide a positive stop to be used when assembling the example one piece flexible tube connector to, for example, another tube or connector in a water supply system.

The example one-piece piece flexible tube connector produced according to the present invention is used, for example, as flexible supply tubing for plumbing applications including water supply systems. The example one-piece flexible tube connector of the present invention includes a thickened portion that is machined into a barbed configuration, which acts as an attachment feature, eliminating the need to attach fittings onto an end of a thin wall tube. As such, the example one-piece configuration also eliminates the potential risk of mechanical failure and/or leakage associated with the known two-piece design.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A method of manufacturing a one-piece flexible tube connector comprising the steps of:

securing a tube blank having a first end, a second end, an initial length, an initial outer diameter, and an initial wall thickness in a fixture;

moving one of the tube blank and a forming tool toward the other of the tube blank and the forming tool until the first end of the tube blank contacts a stop surface of the forming tool;

spinning one of the tube blank and the forming tool to increase the initial wall thickness of a portion of the tube blank adjacent to the first end of the tube blank to a second wall thickness while maintaining the initial outer diameter of the tube blank;

creating an attachment feature in the portion of the tube blank adjacent to the first end of the tube blank having the second wall thickness; and creating a shoulder on the tube blank having a diameter greater than the initial outer diameter of the tube blank, wherein, the attachment feature includes at least one barb having a valley with a root outer diameter that is less than the initial outer diameter of the tube blank, and the shoulder is on an outer portion of a transition portion of the tube blank where the tube transitions from the initial wall thickness to the second wall thickness.

2. The method as recited in claim 1, wherein the tube blank is moved longitudinally toward the forming tool.

3. The method as recited in claim 2, wherein the forming tool is a spinning tool that is spinning.

4. The method recited in claim 1, wherein the forming tool is moved longitudinally toward the tube blank.

5. The method as recited in claim 4, wherein the tube blank is spinning.

6. The method as recited in claim 4, wherein the forming tool is a spinning tool that is spinning and the fixture securing the tube blank is stationary.

7. The method as recited in claim 1, further including the step of controlling the outer diameter of the tube blank while increasing the initial wall thickness to the second wall thickness.

8. The method as recited in claim 1, wherein the portion of the tube blank having the second wall thickness extends along a second length that is less than the initial length.

9. The method as recited in claim 8, further including the step of decreasing the initial length to a third length while increasing the initial wall thickness to the second wall thickness, wherein the third length is greater than the second length.

10. The method as recited in claim 1, wherein the attachment feature is created by one of a forming process and a machining process.

11. The method as recited in claim 1, further including the step of forming a shoulder portion on the tube blank, wherein the shoulder portion has a shoulder diameter that is greater than the initial outer diameter of the tube blank.

12. The method as recited in claim 1, wherein the attachment feature includes another barb at the first end that is smaller than the at least one barb, the another barb having another valley.

13. A method of manufacturing a one-piece flexible tube connector comprising the steps of:

securing a tube blank having a first end, a second end, an initial length, an initial outer diameter, and an initial wall thickness in a fixture;

moving one of the tube blank and a forming tool toward the other of the tube blank and the forming tool until the first end of the tube blank contacts a stop surface of the forming tool;

spinning one of the tube blank and the forming tool to increase the initial wall thickness of a portion of the tube blank adjacent to the first end of the tube blank to a second wall thickness while maintaining the initial outer diameter of the tube blank; and creating an attachment feature in the portion of the tube blank adjacent to the first end of the tube blank having the second wall thickness.

14. The method of manufacturing a one-piece flexible tube connector according to claim 13, wherein the attachment feature is created by a second forming process.

15. The method of manufacturing a one-piece flexible tube connector according to claim 13, wherein the attachment feature is created by a machining process.

16. The method of manufacturing a one-piece flexible tube connector according to claim 13, wherein the attachment feature includes at least one barb having a valley with a root outer diameter that is less than the constant overall outer diameter.

17. The method of manufacturing a one-piece flexible tube connector according to claim 13, wherein the attachment feature includes another barb at the first end that is smaller than the at least one barb, the another barb having another valley.

18. The method of manufacturing a one-piece flexible tube connector according to claim 13, further comprising the step of:

creating a shoulder on the tube blank having a diameter greater than the initial outer diameter of the tube blank.

19. The method of manufacturing a one-piece flexible tube connector according to claim 18, wherein, the shoulder is on an outer portion of a transition portion of the tube blank where the tube transitions from the initial wall thickness to the second wall thickness.

* * * * *